United States Patent [19]

Hupp et al.

[11] 4,292,881

[45] Oct. 6, 1981

[54] AUTOMATIC FIREARM CONSTRUCTION

[75] Inventors: Gerhard Hupp, Oberndorf; Helmut Mäder, Schramberg, both of Fed. Rep. of Germany

[73] Assignee: Mauser-Werke Obendorf GmbH, Fed. Rep. of Germany

[21] Appl. No.: 45,965

[22] Filed: Jun. 6, 1979

[30] Foreign Application Priority Data

Jun. 8, 1978 [DE] Fed. Rep. of Germany ..... 2825091

[51] Int. Cl.[3] ..... F41D 10/04

[52] U.S. Cl. ..... 89/33 CA; 89/33 SF

[58] Field of Search ..... 89/33 R, 33 SF, 33 BA, 89/33 BC, 33 CA

[56] References Cited

U.S. PATENT DOCUMENTS 3,648,561 3/1972 Stoner ..... 89/33 CA 3,875,845 4/1975 Hupp et al. ..... 89/33 SF

*Primary Examiner*—Stephen C. Bentley

*Attorney, Agent, or Firm*—McGlew and Tuttle

[57] ABSTRACT

An automatic firearm and particularly a gas operated weapon comprises a cartridge feeding system which operates upon movement of a reciprocating breech block during recoil and counter recoil to feed a series of cartridges in succession to the cartridge chamber of the gun barrel under the control of gas pressure which is generated during the firing of each cartridge. The cartridge feeding mechanism includes a drive head having a rotatable bushing which is driven by a gear drive and with an end drive face which has an engagement slot therein formed with inwardly tapering walls in a direction inwardly of the drive face. A cartridge feed mechanism is pivoted to the drive head and it may be positioned in engagement with the drive head or removed for purposes of changing ammunition. The cartridge feed mechanism includes a drive hub with a transfer element in said hub which has an outwardly tapered coupling portion which is engageable in the slot of the drive face of the rotatable bushing.

1 Claim, 3 Drawing Figures

AUTOMATIC FIREARM CONSTRUCTION

FIELD AND BACKGROUND OF THE INVENTION

This invention relates in general to the construction of firearms and in particular to a new and useful drive head having a rotatable bushing with an end drive face with an engagement slot which is engageable by a coupling projection of a drive element carried in a drive hub of the cartridge feed mechanism.

An automatic firearm with recoil and counter recoil motion of the feed block is disclosed in U.S. Pat. No. 3,875,845 dated Apr. 8, 1975. That patent is directed to a cartridge feed mechanism avoiding or eliminating the drawbacks and disadvantages of prior art firearms and permitting the switching from one sort of ammunition to another within a minimum time and with a relatively small force, and with which, upon the switching, the first shot with the desired ammunition is immediately discharged. It is also provided that the cartridge feed is independent of the breech motion, to minimize the acceleration forces acting on the belt and to obtain a short overall length of the weapon.

Even though the solution of U.S. Pat. No. 3,875,845 was satisfactory in dealing with the problem posed and fully coming up to expectations as to the performance in practice, it can still be improved to better comply with the rough combat conditions and the high strain as well as the indispensable maintenance connected thereto. From this point of view, the present invention is directed to a cartridge feed mechanism which, particularly in order to facilitate the maintenance, is easier to handle, namely can be more easily swung about its joint or point of support.

SUMMARY OF THE INVENTION

In accordance with the present invention the drive head of the weapon includes a rotatable bushing having an annular gear thereon which is engaged with a drive gear to rotate it. The bushing includes an end drive face disposed opposite a slot for receiving a cartridge feed mechanism which is pivoted to the drive head. The cartridge feed mechanism includes a drive hub having a driving element therein with a coupling portion which tapers inwardly in an outwardly extending direction from the element and engages in the similarly oppositely tapered slot of the drive face of the drive head.

The construction of the invention insures easy maintenance and improved operation of the drive for the magazine.

Accordingly it is an object of the invention to provide an improved automatic firearm which includes a drive mechanism in the form of a drive head mounted on the firearm having at least one rotatable bushing with an end drive face having an inwardly tapered engagement slot which includes gear means connected thereto for rotating it and which also includes a cartridge feed mechanism which is pivoted to the drive head and which may be pivoted into a position in which a coupling portion which extends outwardly therefrom and is tapered inwardly in an outward direction engages into the slot of the drive head.

A further object of the invention is to provide a weapon which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which preferred embodiments of the invention are illustrated.

GENERAL DESCRIPTION OF THE PREFERRED EMBODIMENTS

Figure 1:
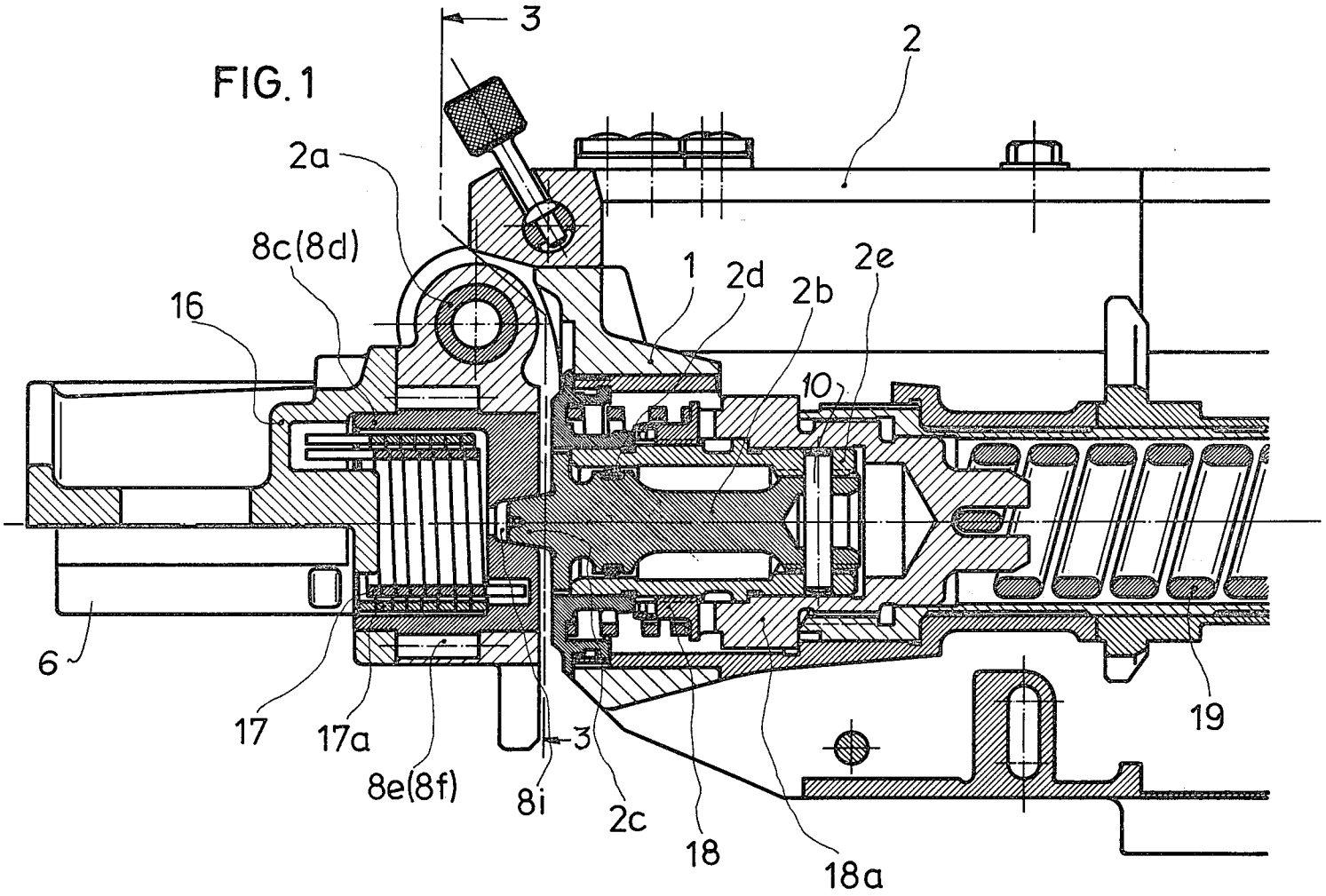
FIG. 1 is a partial vertical sectional view of a cartridge feed mechanism for a weapon constructed in accordance with the invention.

Referring to the drawings in particular, the invention embodied therein relates to an automatic firearm particularly a gas operated weapon of the same type indicated in U.S. Pat. No. 3,875,845 dated Apr. 8, 1975. The present invention is an improvement over that patent in respect to only the drive head and the cartridge feed mechanism and the remaining portion of the weapon is as disclosed in this patent, disclosure of which is incorporated herein by reference.

Figure 2:
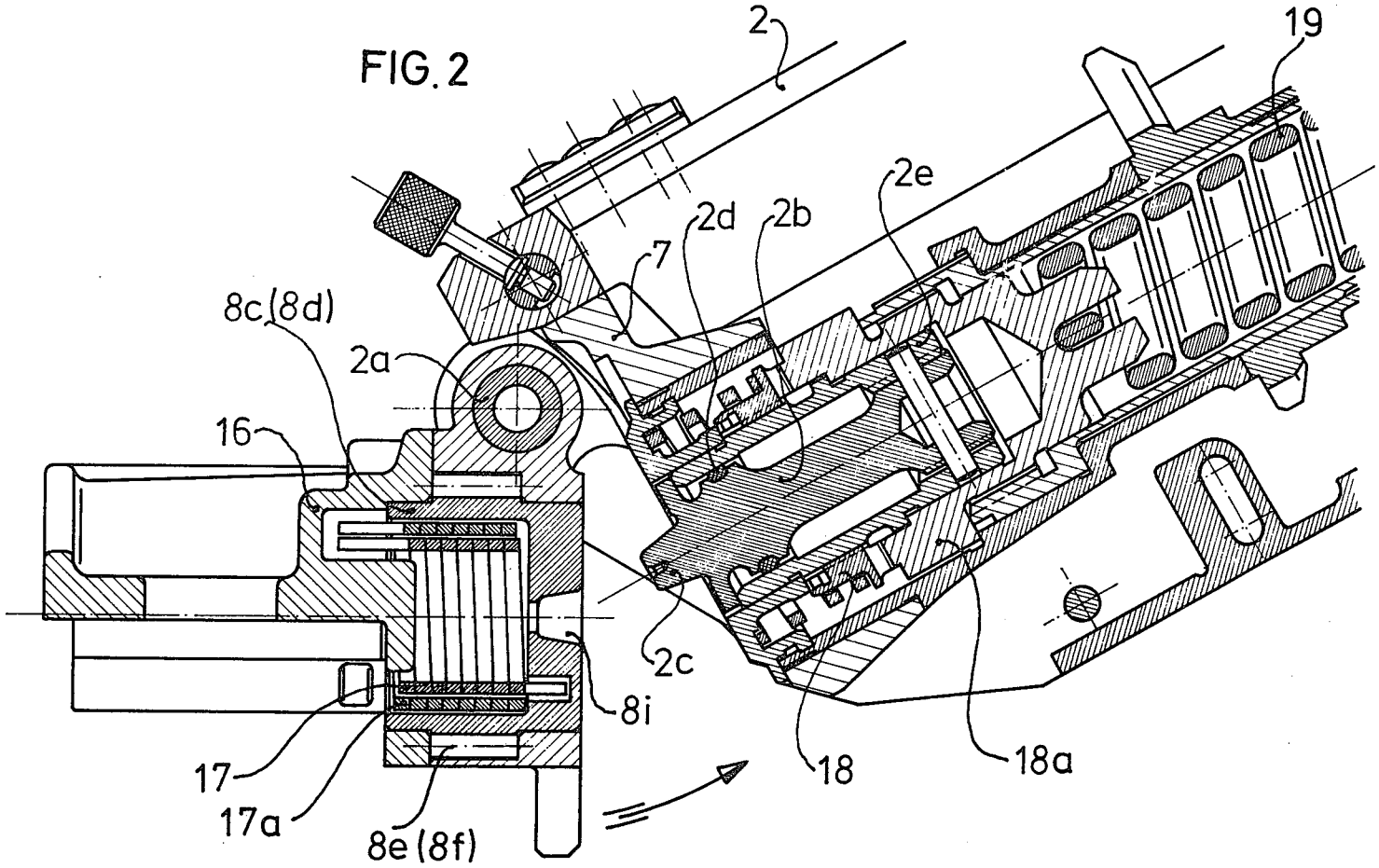
FIG. 2 is a view similar to FIG. 1 indicating the cartridge feed mechanism in a position in which the feed mechanism is disengaged from the drive head.

Referring to the drawings in particular, the invention embodied therein comprises a gun having a drive system for a magazine which includes a drive head 16 which is hinged at a pivot **2*a* to a cartridge feed mechanism 2. The head 16 is mounted on a guide 6 of the weapon and it comprises a drive mechanism for a cartridge feeding system which operates upon movement of a reciprocating breech block to feed a series of cartridges in succession to the cartridge chamber of the gun barrel (not shown). The weapon is particularly suitable for operation under the control of gas pressure which is generated during the firing of each cartridge. For this purpose the drive head includes one or more (in this embodiment two) drive bushings 8*c* and 8*d* which have annular gears 8*e* and 8*f* respectively which are interengaged and are driven by a drive piston (not shown). The bushings 8*e* and 8*f* are connected to the drive head 16 through springs 17 and 17*a* respectively. In accordance with the invention each bushing 8 has a drive face with an inwardly tapering slot 8*i* which extends transversely to the longitudinal axis of the weapon. In the operating position shown in FIG. 1, one of the two conformable coupling portions 2*c* of transfer elements 2*b* of a cartridge feed mechanism 2 is engaged in a respective slot 8*i*. Transfer elements 2*b* are contained within a drive hub 2*e* of the cartridge feed mechanism. In FIG. 2** the parts are shown in the disengaged position.

In the coupled or engaged position the tapering surfaces of one of the slots **8*i* transfers the driving power to one of the coupling portions 2*c* of one of the transfer elements 2*b* and through a stepping mechanism 18 and 18*a* to a drive spring 19. In the preferred design the drive spring 19 is made of a spring stock having a square cross section and is capable of withstanding torsional stress. The accumulated energy imparted into the drive spring 19** is transmitted to a cartridge belt (not shown)

so that a new cartridge can be advanced to the feed position.

The transfer elements for the cartridges designated 2*b*, 2*b* are mounted in the drive hub 2*e* on gimbals 10 and are centered therein by means of a resilient element 2*d*. This makes it possible to compensate for any axial misalignment between the cartridge feed mechanism 2 and the drive head 16.

Figure 3:
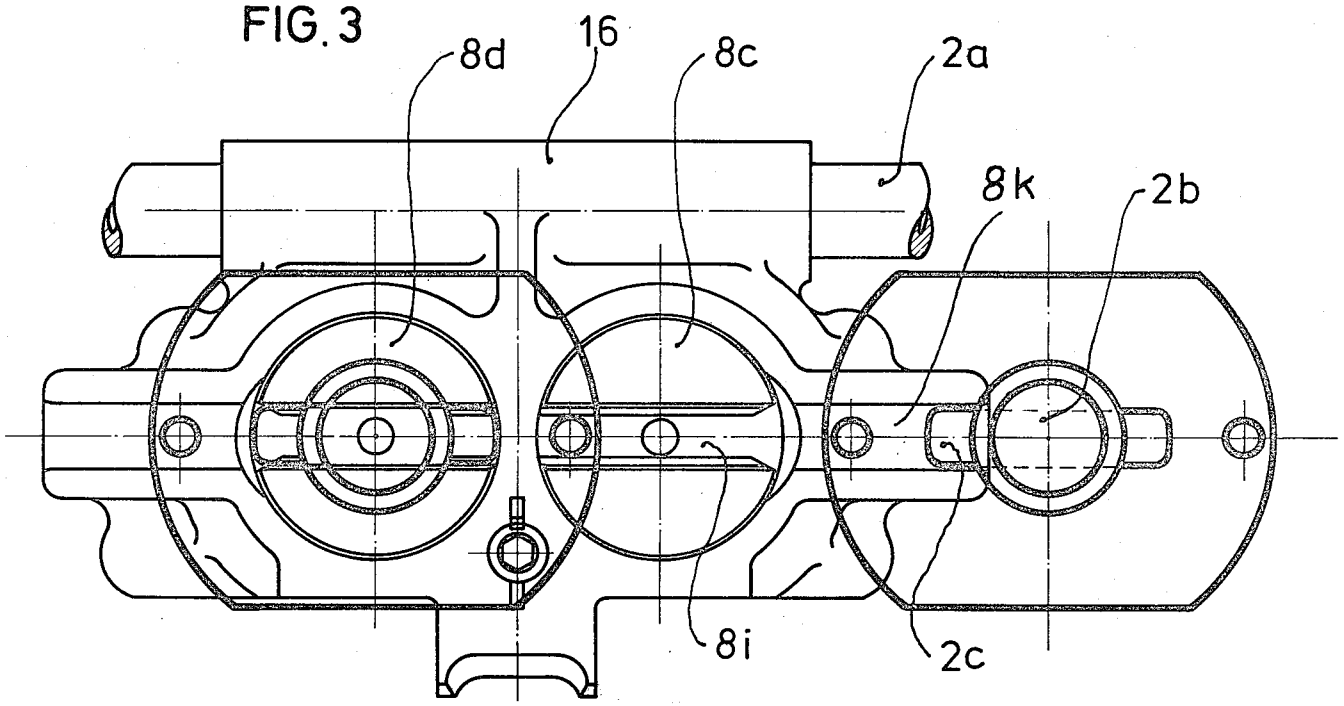
FIG. 3 is a partial end elevational view taken along the lines 3—3 of FIG. 1.

As shown in FIG. 3 slot 8*k* is provided in drive head 16 as an extension of slot 8*i* and it is provided in approximately cylindrical bushings 8*c* and 8*e*. Slot 8*k* is intended for receiving coupling portion 2*c* in its disengaged position. In this manner, the transfer element 2*b* carrying the coupling portion 2*c* is secured against turning.

While specific embodiments of the invention have been shown and described in detail to illustrate the application of the principles of the invention, it will be understood that the invention may be embodied otherwise without departing from such principles.

What is claimed is:

1. In an automatic firearm of the type having a reciprocating breech block, a cartridge feed mechanism which is driven by the gas pressure through a piston, which extends parallel to the longitudinal axis of the firearm, which is capable of receiving at least two different sorts of ammunition and which is operated to feed a plurality of different types of ammunition into the counter recoil path of the breech block, the improvement comprising a rotatable bushing mounted in the drive head having an end drive face adjacent the feed mechanism with a slot therein which tapers inwardly, means for pivotally mounting the cartridge feed mechanism to said drive head, the cartridge feed mechanism including a housing portion, a drive hub rotatably mounted in said housing portion, a transfer element in said drive hub having a coupling projecting outwardly therefrom and being tapered inwardly in an outward direction and being engageable in said slot of said end drive face for transmitting the drive motion for the cartridge feed mechanism, and means operatively connecting said transfer element to said drive hub for resilently centering said transfer element for reception in said slot.

* * * * *